US005600419A

United States Patent [19]

Sakuraba et al.

[11] Patent Number: 5,600,419

[45] Date of Patent: Feb. 4, 1997

[54] DEVELOPING DEVICE HAVING BIASING CIRCUIT FOR CHARGE ERASING MEMBER

[75] Inventors: Tamotsu Sakuraba; Shinichi Takemoto, both of Toyokawa, Japan

[73] Assignee: Minolta Co., Ltd., Osaka, Japan

[21] Appl. No.: 509,086

[22] Filed: Aug. 1, 1995

[30] Foreign Application Priority Data

Aug. 1, 1994 [JP] Japan ..... 6-180188

[51] Int. Cl.[6] ..... G03G 15/06

[52] U.S. Cl. ..... 399/285; 399/283; 399/90

[58] Field of Search ..... 355/259, 261; 118/651, 661

[56] References Cited

U.S. PATENT DOCUMENTS

| | | | |
|---|---|---|---|
| 4,561,381 | 12/1985 | Kaneko et al. | 118/652 |
| 4,656,964 | 4/1987 | Kanno et al. | 118/651 X |
| 4,745,429 | 5/1988 | Mukai et al. | 355/261 |
| 4,930,438 | 6/1990 | Demizu et al. | 118/651 |
| 5,057,871 | 10/1991 | Hirose et al. | 355/259 |
| 5,206,691 | 4/1993 | Mizuno et al. | 355/259 |
| 5,477,006 | 12/1995 | Imamiya et al. | 118/651 |

*Primary Examiner*—Robert Beatty

*Attorney, Agent, or Firm*— Burns, Doane, Swecker & Mathis, LLP

[57] ABSTRACT

A developing device for use in an image forming apparatus like a copying machine or printer that develops an electrostatic latent image formed on an electrostatic latent image carrier to obtain a visible image. In the developing device, a toner charge erasing member contacts with the surface of a developing agent carrier and is connected to a power supply which applies developing bias voltage, so that a toner charge erasing bias voltage is applied to the toner charge erasing member from the power supply. A connection circuit provided between the toner charge erasing member and the power supply to maintain a constant electric potential difference between the developing bias voltage and the toner charge erasing bias voltage.

23 Claims, 2 Drawing Sheets

DEVELOPING DEVICE HAVING BIASING CIRCUIT FOR CHARGE ERASING MEMBER

BACKGROUND OF THE INVENTION

1. Field of the Invention

The present invention relates to a developing device for use in an image forming apparatus like a copying machine or printer that develops an electrostatic latent image formed on an electrostatic latent image carrier to obtain a visible image, and more particularly, to a one-component developing device that develops an electrostatic latent image employing a one-component developing agent as a developing agent.

2. Description of the Related Arts

Conventionally, a one-component developing device that develops an electrostatic latent image employing a one-component developing agent in a developing device used in an image forming apparatus like a copying machine or printer has been known. The one-component developing device develops an electrostatic latent image formed on an electrostatic latent image carrier like a photosensitive member or a dielectric member to obtain a visible image. Normally, the one-component developing device is provided with a developing agent carrier such as a developing roller, developing sleeve or a developing belt opposite the electrostatic latent image carrier. The developing agent carrier holds the one-component developing agent on its surface and carries out the developing process by transferring developing agent from a developing agent storage portion to the opposing portion of the electrostatic latent image carrier (referred to "developing region" hereinafter). After developing, residual toner attached to the developing sleeve is returned to the developing agent storage portion by the rotation of the developing sleeve.

The toner returned to the storage portion is removed from the developing sleeve although, one portion of highly charged toner remains on the surface of the developing sleeve. This remaining toner forms a micro-electric field between the itself and the developing sleeve. This micro-electric field draws subsequently supplied toner to the top of the developing sleeve.

However, when a low humidity environment causes the toner to flow more, the charge amount of the toner also increases thus the toner is not removed from the developing sleeve with a tendency for the highly charged toner accumulating on the developing sleeve to increase. Therefore, the amount of toner drawn to the developing sleeve increases and the amount of toner adhering to the sleeve becomes impossible to restrict even by the restricting blade resulting in an abnormal amount of toner being transferred to the electrostatic latent image carrier in the developing region. If an abnormal amount of toner is transferred to the electrostatic latent image carrier in the developing region, the non-image portion will also be developed, memory phenomenon will occur in which a developed image remains on the developing sleeve, and problems such as toner scattering around the periphery of the sleeve will occur.

Furthermore, this results in the toner accumulating on the developing sleeve repeatedly receiving stress from the restricting blade thus adhering to the developing sleeve. This phenomenon is called "filming". Filming is the cause of degrading image quality.

Further, when the toner on the developing sleeve receives stress, toner become to have a small diameter or fluid silica contained in the toner is peeled. As a result reproducibility of black portions of the image is poor.

Even further, when the toner accumulating on the developing sleeve increases, toner newly supplied to the developing sleeve is not only charged by the restricting blade but is also charged by the friction of the other toner. Therefore, the charging polarity of the toner opposite that of the regular charging polarity increases resulting in deterioration of image quality.

In one such disclosure of a developing device in U.S. Pat. No. 4,930,438, a charge erasing brush is provided to weaken the electrostatic adhesion force of the residual toner on the developing sleeve. A power supply with a voltage identical to the developing bias voltage applied to the developing sleeve applies a voltage identical to the developing bias voltage to this charge erasing brush. The charge erasing brush then erases unnecessary accumulating charge from the residual toner using this applied voltage to weaken the electrostatic adhesion force of the residual toner on the developing sleeve.

However, when a voltage identical to the developing bias voltage is applied to the charge erasing brush, it becomes impossible to erase the charge of a voltage lower than the developing bias voltage even if an accumulated charge higher than the developing bias voltage can be removed.

SUMMARY OF THE INVENTION

The object of this invention is to provide a developing device that achieves an excellent developing to obtain an excellent image.

Another object of this invention is to provide a developing device that achieves an excellent developing to obtain an excellent image by erasing the charge of residual toner held on the developing agent carrier after developing making it easy to remove residual toner from the developing agent carrier.

Another object of this invention is to provide a developing device that achieves an excellent developing to obtain an excellent image by erasing the charge of residual toner held on the developing agent carrier as desired and avoiding problems such as memory phenomenon or abnormal toner adhesion due to insufficient charge erasure and poor conditions such as occurrences of electrical discharge.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
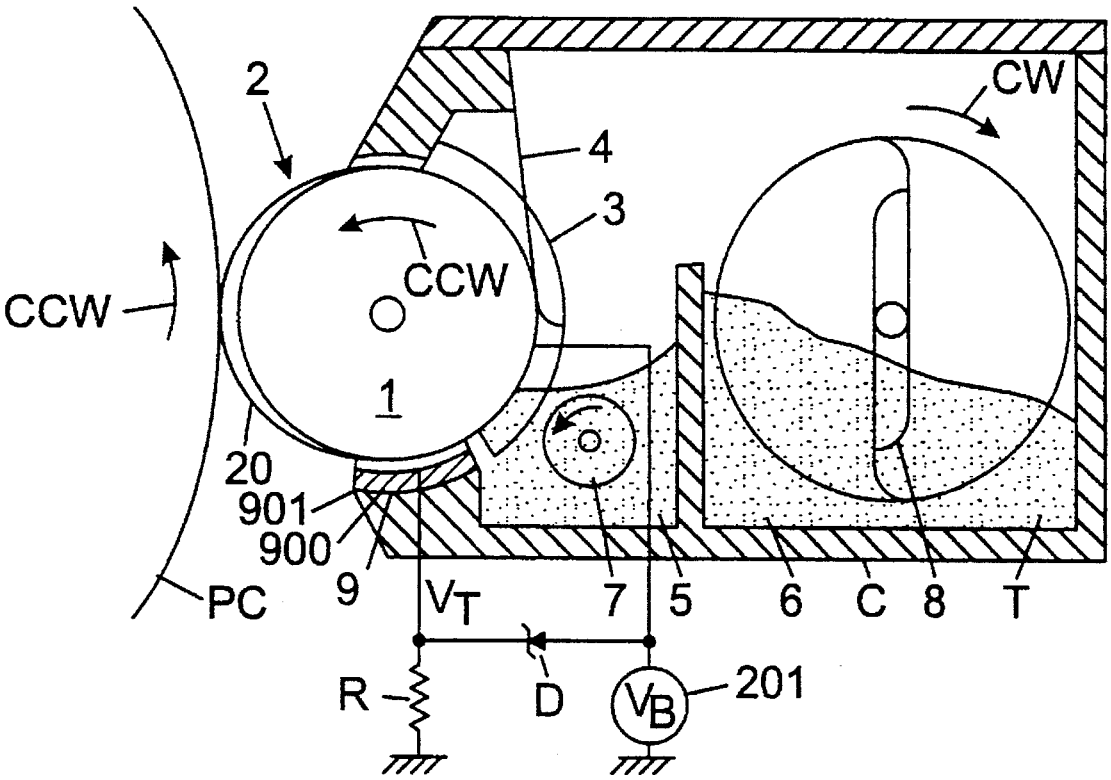
FIG. 1 is an outline cross-sectional view according to one preferred embodiment of the present invention.

Referring now to the drawings, a developing device according to one preferred embodiment of the present invention will be explained.

In the developing device shown in FIG. 1, numerical 1 designates a drive roller, numerical 2 designates a bendable developing sleeve fit on the outside of the drive roller 1, numerical 3 designates a pair of pressure guides which press both edges of the developing sleeve 2, numerical 4 designates a toner restricting blade making contact with the developing sleeve 2, numerical 5 designates a buffer chamber, numerical 6 designates a toner supply chamber, numerical 7 designates a toner supply member arranged in the buffer chamber 5, numerical 8 designates a toner stirring member arranged in the toner supply chamber 6, and T designates the toner used.

The inside diameter of the developing sleeve 2 which is the developing agent carrier is somewhat larger than the outside diameter of the drive roller 1. A loosening portion 20 achieved by the pressure guides 3 pressing the developing sleeve 2 loosely makes contact with the surface of a photoreceptor drum PC which is the electrostatic latent image carrier. The drive roller 1 and toner supply member 7 are rotated in the counterclockwise direction (CCW direction in the figure) by a drive motor (not shown in figure). The developing sleeve 2 is rotated in the counterclockwise direction (CCW direction in the figure) by the frictional force of the drive rotation of the drive roller 1. Further, the toner stirring member 8 is rotated in the clockwise direction (CW direction in the figure) by the drive motor (not shown in figure). Negatively charged polyester type toner is then used for the toner T although, if necessary, another toner can be used.

In the developing device shown in FIG. 1, the toner T is transferred to the buffer chamber 5 from the toner supply chamber 6 by the rotation of the toner stirring member 8. The toner T transferred to the buffer chamber 5 is supplied to the surface of the developing sleeve 2 in order at developing agent supply regions by the rotation of the toner supply member 7.

The toner T supplied to the surface of the developing sleeve 2 is transferred by the rotation of the developing sleeve 2 passing between the toner restricting blade 4 and the developing sleeve 2. During this time, the toner T is triboelectrically charged by the pressure of the toner restricting blade 4 forming a thin film at a specified thickness. The toner T which formed a thin film at a specified thickness is held on the surface of the developing sleeve 2, transferred to the developing regions confront the photoreceptor drum PC where it is used to develop the electrostatic latent image.

Furthermore, in the developing device shown in FIG. 1, numerical 9 designates a toner charge erasing member that serves as a lower seal member to prevent toner from leaking outside of the buffer chamber 5. The charge erasing member 9 is supported at the developing device casing C. The charge erasing member 9 passes transversely over the surface movement direction (CCW direction in the figure) of the developing sleeve 2 making contact with the surface of the sleeve 2 either through the toner layer or directly. The charge erasing member 9 is located at a region extending to the toner restricting blade 4 from the downstream side from the developing region in the rotation direction of the developing sleeve 2. Residual toner T from among the toner T used for developing in the developing region passes between the charge erasing member 9 and developing sleeve 2 to return to the buffer chamber 5.

The surface of the charge erasing member 9 makes contact with at least the developing sleeve 2 and is formed by a material having the same polarity as the toner T. Further, it is preferable for this material to have same polarity as the toner T in view of the triboelectric series. Also, a material with good conductivity dispersed throughout is used for the material forming the charge erasing member 9. Thus, the charge erasing member 9 includes a main body 900 and a tape 901 which is adhered to the surface of the main body 900. The main body 900 is formed with a soft elastic material such as polyurethane foam. The tape 901 formed with polytetrafluoroethylene resin and contains carbon black dispersed throughout allowing conductivity. The surface roughness (Rz) of the tape 901 is approximately 5 μm with this roughness making contact with the developing sleeve 2. The surface roughness (Rz) of the tape 901 can be larger than 5 μm although, if it is too rough, noise appearing as streaks will occur on the developing sleeve 2 thus, the roughness Rz should be smaller than 20 μm.

In the developing device shown in FIG. 1, a direct current power supply 201 used for developing bias voltage is connected to the developing sleeve 2 and the charge erasing member 9 by a connection circuit. Therefore, the connection circuit applies developing bias voltage $V_B$ to the developing sleeve 2 as well as the toner charge erasing bias voltage $V_T$ to the charge erasing member 9. The connection circuit is constructed such that a power supply 201 connects to the tape 901 portion of the charge erasing member 9 through a zener diode D. The zener diode D is grounded through a protection circuit R (50 MΩ). In this example, the developing bias voltage $V_B$ applied to the developing sleeve 2 from the power supply 201 is −300V.

The zener diode D generates a voltage drop by flowing current through resistor R. Thereby, the zener diode D applies a toner charge erasing bias voltage $V_T$ with a constant electric potential difference relative to the developing bias voltage $V_B$ to the charge erasing member 9. In this example, said constant electric potential difference is 100V thus the toner charge erasing bias voltage $V_T$ is −200V.

The toner charge erasing bias voltage $V_T$ applied to the charge erasing member 9 draws the toner T to the charge erasing member 9 when passing through the charge erasing member 9. The electrical charge is removed from the toner T drawn to the charge erasing member 9 by contact and friction with the charge erasing member 9. When the toner T returns to the buffer chamber 5, the charge erasing action of the charge erasing member 9 makes it easy to remove the toner from the surface of the developing sleeve 2.

According to the developing device of FIG. 1, even if the developing bias voltage $V_B$ changes in order to adjust the image density, the electric potential difference between the toner charge erasing bias voltage $V_T$ and the developing bias voltage $V_B$ is substantially maintained at a constant level by the zener diode D. Consequently, it is impossible for this electric potential difference to grow too small or too large. The developing device of FIG. 1 can prevent insufficient charge erasure of the toner resulting in memory phenomenon or abnormal toner adhesion due to the electric potential difference between the toner charge erasing bias voltage $V_T$ and the developing bias voltage $V_B$ becoming too small, while the developing device of FIG. 1 can also prevent as gaseous discharge resulting in drops in the effectiveness of charge erasure or damage to the charge erasing member due to the electric potential difference between the toner charge erasing bias voltage $V_T$ and the developing bias voltage $V_B$ becoming too large. Furthermore, because the developing device of FIG. 1 can maintain a high charge erasure effectiveness by maintaining the electric potential difference between the toner charge erasing bias voltage $V_T$ and the developing bias voltage $V_B$ at a constant level, the replaceability of the toner is improved thus preventing toner deterioration and filming. In this way, excellent developing can be achieved thus obtaining a excellent image by using the developing device of FIG. 1.

Figure 2:
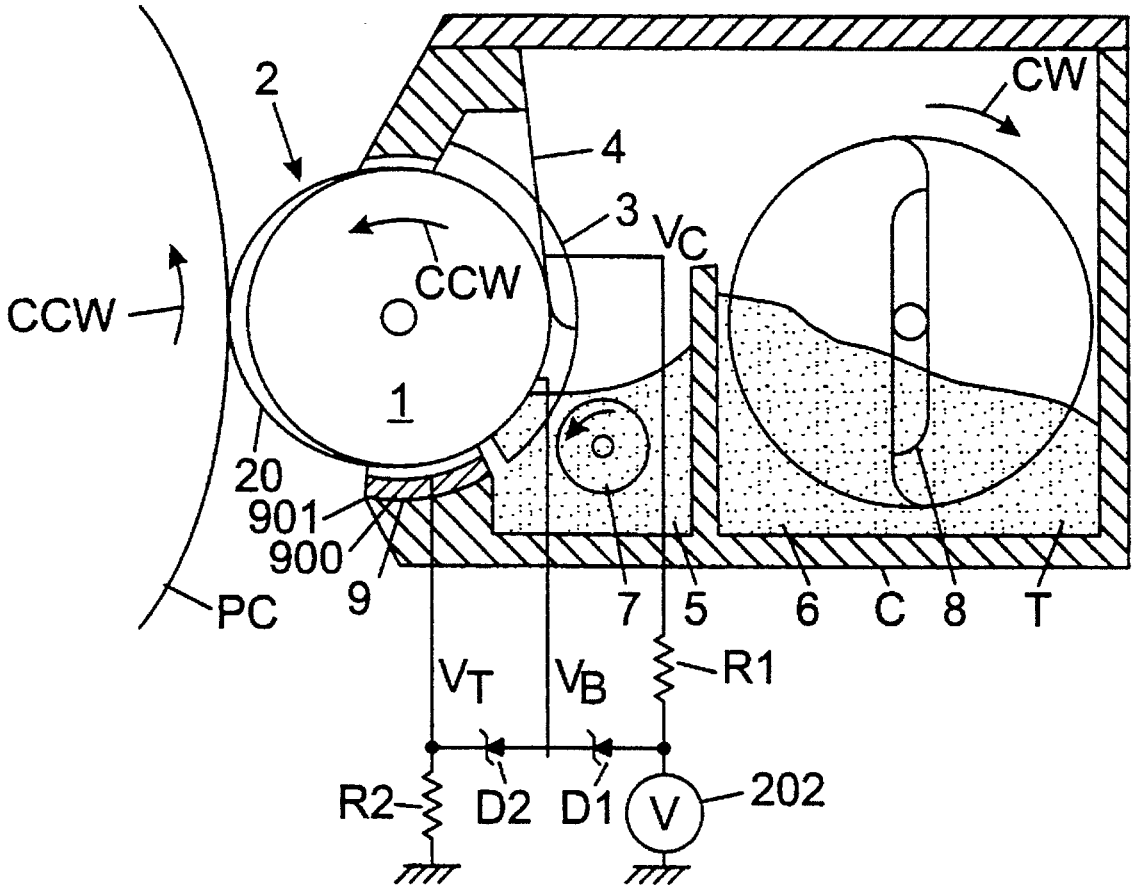
FIG. 2 is an outline cross-sectional view according to another embodiment of the present invention.

The developing device shown in FIG. 2 is another example of this invention. The developing device shown in FIG. 2 is constructed identical to the developing device of FIG. 1 other than the circuit apparatus used to apply bias voltage. Therefore, detailed description for the developing device shown in FIG. 2 has been abbreviated here with like parts being designated by like reference numerals of the developing device of FIG. 1. Moreover, the toner used is also negatively charged polyester type toner like the developing device of FIG. 1. However, for this case also, the toner can be changed if necessary.

The developing device of FIG. 2 is also provided with a like power supply 202 which is connected to the developing sleeve 2 and the toner charge erasing member 9 by means of a connection circuit. This power supply 202 is connected to the developing sleeve 2 through a first zener diode D1 of the connection circuit. Further, this power supply 202 is also connected to the toner restricting blade 4 through the resistor R1 (50 MΩ). The power supply 202 is further connected to the toner charge erasing member 9 through the first zener diode D1 and a second zener diode D2 as well as being grounded through a protection circuit R2 (50 MΩ).

In the developing device shown in FIG. 2, the power supply 202 supplies —550 VDC. A restricting bias voltage $V_c$ of slightly less than —550V is applied to the restricting blade 4 through the resistor R1. Further, the developing bias voltage $V_B$ applied to the developing sleeve 2 is set to –300V by the zener diode D1 causing a voltage drop (250V). The toner charge erasing bias voltage $V_T$ applied to the toner charge erasing member 9 is set to –200V by the first zener diode D1 in addition to the second zener diode D2 causing a voltage drop (100V).

The electric potential difference between the developing bias voltage $V_B$ and the toner charge erasing bias voltage $V_T$ is set at a constant 100V by the second zener diode D2.

Identical to the developing device shown in FIG. 1, in the developing device shown in FIG. 2, the toner T is also held on the surface of the developing sleeve 2 and used for developing in the developing region. Residual toner T from among the toner T used for developing in the developing region passes between the charge erasing member 9 and developing sleeve 2 to return to the buffer chamber 5. Then, the toner T is drawn to the charge erasing member 9 by the toner charge erasing bias voltage $V_T$ applied to the charge erasing member 9 when passing through the charge erasing member and the electrical charge is removed from by contact and friction with the charge erasing member 9 thus, making it easy to remove the toner from the surface of the developing sleeve 2 when the toner returns to the buffer chamber 5.

Even if the developing bias voltage $V_B$ is adjusted to adjust the image density, the electric potential difference between the toner charge erasing bias voltage $V_T$ applied to the charge erasing member 9 and the developing bias voltage $V_B$ is essentially constantly maintained by the zener diode D2. Therefore, toner charge erasure is carried out as desired making it impossible for this electric potential difference to grow too small or too large. The developing device of FIG. 2 can prevent insufficient charge erasure of the toner resulting in memory phenomenon or abnormal toner adhesion due to the electric potential difference between the toner charge erasing bias voltage $V_T$ and the developing bias voltage $V_B$ becoming too small, while the developing device of FIG. 2 can also prevent a gaseous discharge resulting in drops in the effectiveness of charge erasure or damage to the charge erasing member due to the electric potential difference between the toner charge erasing bias voltage $V_T$ and the developing bias voltage $V_B$ becoming too large. Furthermore, because the developing device of FIG. 2 can maintain a high charge erasure effectiveness by maintaining the electric potential difference between the toner charge erasing bias voltage $V_T$ and the developing bias voltage $V_B$ at a constant level, the replaceability of the toner is improved thus preventing toner deterioration and filming. In this way, excellent developing can be achieved thus a excellent image obtained by using the developing device of FIG. 2.

Additionally, the developing device of FIG. 2 maintains an essentially constant electric potential difference between the restricting bias voltage $V_C$ applied to the restricting blade 4 and the developing bias voltage $V_B$ applied to the developing sleeve 2 using the zener diode D1. Consequently, a constant relationship is maintained between the electric potential difference between the restricting bias voltage $V_C$, the developing bias voltage $V_B$ and the toner charge erasing bias voltage $V_T$ by the zener diodes D1, D2. This is how the developing device of FIG. 2 can achieve more excellent developing.

As described above, either of the developing devices of FIG. 1 or FIG. 2 can achieve erasure of the charge of residual toner by the toner charge erasing member 9. When erasure of the charge of residual toner can be achieved, the residual toner can be easily removed from the developing sleeve 2 in the buffer chamber 5. Therefore, the transport quantity of the toner to the developing region and the charge of that toner can be maintained at an optimum level. Furthermore, poor conditions such as toner accumulation on the developing sleeve 2, toner deterioration and toner filming can be controlled to obtain a excellent image without toner adhering to the non-image portion or toner scattering.

Moreover, although the embodiment described above uses a flexible developing sleeve as the developing agent carrier, another form of a developing device which uses a developing sleeve not flexible or a developing roller formed by an elastic member can be applied to this invention. Although the toner used in the embodiment described above has a negative electric charge, toner with a positive electric charge can also be used with this invention.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A developing device for developing an electrostatic latent image on an electrostatic latent image carrier comprising:

a toner carrying member opposed to said electrostatic latent image carrier and having a movable surface on which a toner is held;

a charge erasing member being in contact with said surface of said toner carrying member;

a developing bias power unit; and a connection circuit for connecting said developing bias power unit with said charge erasing member and said toner carrying member so as to maintain a predetermined electric potential difference between said developing bias power unit and said charge erasing member.

2. A developing device as claimed in claim 1, wherein said charge erasing member is located at a position downstream of said developing region with respect to the moving direction of said surface of said toner carrying member.

3. A developing device as claimed in claim 1, wherein said toner carrying member includes a thin film developing sleeve which is loosely mounted around a drive roller, a peripheral length of the sleeve being slightly longer than a peripheral length of said drive roller, said drive roller being driven to rotate.

4. A developing device as claimed in claim 1, further comprising a toner restricting member being in contact with the surface of said toner carrying member.

5. A developing device as claimed in claim 4, wherein said toner restricting member located at a position upstream of said developing region with respect to the moving direction of said surface of said toner carrying member.

6. A developing device as claimed in claim 4, wherein said connection circuit connects said toner restricting member with said toner carrying member so as to maintain a constant electric potential difference between said toner restricting member and said toner carrying member.

7. A developing device as claimed in claim 4, wherein charge erasing bias voltage is applied to said charge erasing member and developing bias voltage is applied to said toner carrying member and toner restricting bias voltage is applied to said toner restricting member, an absolute value of charge erasing bias voltage being smaller than an absolute value of developing bias voltage and an absolute value of developing bias voltage being smaller than an absolute value of toner restricting bias voltage.

8. A developing device as claimed in claim 1, wherein said developing device is a one-component developing device.

9. A developing device as claimed in claim 1, wherein said charge erasing member serves as a sealing member for preventing leaks of said toner.

10. A developing device as claimed in claim 1, wherein said a charge erasing member is formed of material of which charge polarity is in the same side as a charge polarity of said toner in view of the triboelectric series.

11. A developing device as claimed in claim 1, wherein said charge erasing member is formed of material which contains electrically conductive material dispersed therein.

12. A developing device as claimed in claim 1, wherein said charge erasing member includes a surface formed with polytetrafluoroethylene.

13. A developing device as claimed in claim 1, wherein said charge erasing member includes an elastic material and a tape adhered on a surface of said elastic material.

14. A developing device as claimed in claim 13, wherein said tape is formed of material which contains carbon black dispersed therein.

15. A developing device as claimed in claim 1, wherein said charge erasing member includes a surface whose roughness(Rz) satisfies a following equation:

$$2\ \mu m < Rz < 20\ \mu m.$$

16. A developing device as claimed in claim 1, wherein said connection circuit contains a Zener diode.

17. A developing device as claimed in claim 16, wherein said connection circuit connects said developing bias power unit with said charge erasing member through the Zener diode, and connects a protection circuit which is grounded.

18. A developing device as claimed in claim 1, further comprising a toner restricting member; wherein said connection circuit connects said developing bias power unit with said toner restricting member, said developing bias power unit with said toner carrying member through a first Zener diode, and said developing bias power unit with said charge erasing member through said first Zener diode and a second Zener diode.

19. A developing device as claimed in claim 1, wherein charge erasing bias voltage is applied to said charge erasing member and developing bias voltage is applied to said toner carrying member, an absolute value of said charge erasing bias voltage being smaller than an absolute value of said developing bias voltage.

20. A one-component developing device for developing an electrostatic latent image on an electrostatic latent image carrier comprising:

a toner carrying member which is opposed to said electrostatic latent image carrier and has a movable surface for holding said toner thereon;

a toner restricting member located at a position, which is upstream, with respect to a moving direction of said surface of said toner carrying member, to a developing region formed in opposed portions of said electrostatic latent image carrier and said toner carrying member, said toner restricting member in contact with being said toner carrying member, said toner restricting member being in contact with said surface of said toner carrying member;

a charge erasing member located in a region extending from a position, which is downstream, with respect to the moving direction of said surface of said toner carrying member, to said developing region, to a position upstream to said toner restricting member, said charge erasing member being in contact with said surface of said toner carrying member;

a developing bias power unit applying a developing bias voltage to said toner carrying member being which said developing bias power unit connected to said charge erasing member; and a connection circuit connected between said developing bias power unit and said charge erasing member, wherein a constant electric potential difference is maintained.

21. A developing device for developing an electrostatic latent image on an electrostatic latent image carrier comprising:

a toner carrying member opposed to said electrostatic image carrier and having a movable surface on which a toner is held;

charge erasing means for erasing a charge on the toner carrying member;

a developing bias power unit; and circuit means for maintaining a predetermined electric potential difference between said developing bias power unit and said charge erasing member.

22. A developing device as claimed in claim 21, wherein said circuit means connects the developing bias power unit with the charge erasing means.

23. A developing device as claimed in claim 21, wherein said circuit means includes a diode.

* * * * *